United States Patent [19]

Hauers et al.

[11] Patent Number: 4,742,674

[45] Date of Patent: May 10, 1988

[54] BOBBIN DOFFING AND DONNING APPARATUS

[75] Inventors: Manfred Hauers, Viersen; Dieter Vits, Neuss, both of Fed. Rep. of Germany

[73] Assignee: Zinser Textilmaschinen GmbH, Fed. Rep. of Germany

[21] Appl. No.: 106,109

[22] Filed: Oct. 7, 1987

[30] Foreign Application Priority Data

Oct. 13, 1986 [DE] Fed. Rep. of Germany ..... 3634879

[51] Int. Cl.[4] ..... D01H 9/18; D01H 9/00; B66C 1/44

[52] U.S. Cl. ..... 57/275; 57/266; 57/274; 57/281; 294/88; 294/92; 294/93; 294/100

[58] Field of Search ..... 57/266, 267, 273–276, 57/281; 294/81.52, 81.53, 67.32, 87.1, 87.2, 88, 92, 93, 99.1, 100, 102.1

[56] References Cited

U.S. PATENT DOCUMENTS

| | | | |
|---|---|---|---|
| 1,804,843 | 5/1931 | Santiago | 294/93 X |
| 2,962,856 | 12/1960 | Ingham, Jr. | 57/275 |
| 3,017,216 | 1/1962 | Henry et al. | 294/92 X |
| 3,123,967 | 3/1964 | Ingham, Jr. | 57/275 X |
| 3,431,012 | 3/1969 | Courtois et al. | 294/92 X |
| 3,462,934 | 8/1969 | Schulz et al. | 57/275 |
| 3,633,959 | 1/1972 | McCollough et al. | 57/275 X |
| 4,130,314 | 12/1978 | Storm | 294/100 |
| 4,173,368 | 11/1979 | Haverbusch | 294/93 X |
| 4,315,651 | 2/1982 | Endicott, Jr. et al. | 294/93 X |
| 4,659,126 | 4/1987 | Breck et al. | 294/93 X |

*Primary Examiner*—John Petrakes

*Attorney, Agent, or Firm*—Shefte, Pinckney & Sawyer

[57] ABSTRACT

Apparatus for use in doffing and donning roving bobbins on the winding spindles of textile roving machines, wherein a drive nut associated with bobbin gripping components is constrained by an L-shaped guide slot to move axially with respect to the bobbin spindle for positioning the bobbin axially with respect thereto and to further move rotationally with respect to the spindle to orient mating drive components of the bobbin and spindle in proper driving connection.

15 Claims, 3 Drawing Sheets

BOBBIN DOFFING AND DONNING APPARATUS

BACKGROUND OF THE INVENTION

The present invention relates generally to textile apparatus for doffing and donning bobbins from a spinning or winding machine and, more particularly, to an apparatus for gripping and positioning a roving bobbin in proper drive connection on a winding spindle of a roving machine.

In conventional textile roving machines where roving is wound in relatively large packages onto elongate bobbins, the roving bobbins are supported on respective driven spindles of the roving machine in a positively driven fashion typically by the provision of mating drive components on the bobbins and winding spindles. Accordingly, it is necessary when doffing full roving packages from the roving machine and donning empty bobbons onto the vacated winding spindles that the proper drive connection between the mating components be correctly established. Ordinarily, the proper drive connection is achieved by initially placing the empty bobbin on the winding spindle and then rotating the bobbin with respect to the spindle as necessary to properly align and mate their driving components.

SUMMARY OF THE INVENTION

It is accordingly an object of the present invention to provide an automated apparatus for use in the doffing and donning of roving bobbins on a textile roving machine, by which the proper drive connection between the mating drive components of the bobbins and the spindles may be achieved in an automatic fashion.

Briefly described, the apparatus of the present invention basically includes a gripping arrangement for movement into and out of gripping engagement with a roving bobbin and an associated drive arrangement for selectively actuating such movements of the gripping arrangement. The drive arrangement is adapted for movement longitudinally with respect to the axis of a roving machine spindle for axial positioning of the gripped bobbin with respect to the spindle and is further adapted for rotational movement with respect to the axis of the spindle for orienting the drive component of the bobbin relative to the mating drive component of the spindle for proper driving connection thereof.

In the preferred embodiment of the present invention, the apparatus includes a housing adapted to axially receive one longitudinal end of the roving bobbin and the housing supports the gripping and drive arrangements for operation with respect to such bobbin end. The housing has a generally L-shaped guide slot formed therein with one extent of the slot oriented generally parallel to the axis of the bobbin and another extent of the slot oriented generally perpendicular to the first-mentioned extent. The drive arrangement includes a threaded drive spindle mounted on the housing with a drive nut arrangement threadedly supported on the drive spindle with an axial drive surface of the nut arrangement being provided for driving engagement with the gripped end of the bobbin. A guide component, preferably in the form of a guide roller, is mounted on the drive nut arrangement for movement within the L-shaped guide slot to determine movement of the drive nut arrangement either unitarily with the drive spindle or rotationally thereabout.

In one embodiment of the drive arrangement, the drive spindle is mounted to the housing against axial movement relative thereto and for selective reversible rotation thereto in opposite rotary directions. An electric motor is preferably provided for rotating the drive spindle in this embodiment. In another embodiment, the drive spindle is mounted to the housing against rotation relative thereto and for selective axial reciprocation relative thereto. In this embodiment, a fluid-operated piston-and-cylinder unit is preferably provided for reciprocating the drive spindle.

The gripping arrangement preferably comprises a plurality of gripping fingers arranged annularly about the axial drive surface of the drive nut arrangement and a thrust ring arranged within the housing annularly about the gripping fingers and in association with the drive nut arrangement for movement by the drive nut arrangement axially with respect to the housing for actuating movement of the gripping fingers into and out of gripping engagement with the bobbin end. The thrust ring is formed with a tapered cam surface for acting on the gripping fingers and with a shoulder for retaining the thrust ring within the housing. A spring is arranged within the housing between the thrust ring and the drive nut arrangement for biasing the thrust ring and the drive nut arrangement in axial relation to one another while permitting relative axial movement toward one another. The drive nut arrangement preferably includes a bushing forming the axial drive surface thereof with a friction ring formed on the bushing for driving engagement with the gripped end of the bobbin. The drive nut arrangment further includes a shoulder extending radially inwardly from an outward annular surface, with the shoulder engaging on end of the gripping fingers and with the thrust ring encircling the outer annular surface about the gripping fingers. One longitudinal end of the bobbin is provided with a recess therein for receiving an end of the drive spindle adjacent the axial drive surface of the drive nut arrangement.

DESCRIPTION OF THE PREFERRED EMBODIMENT

Figure 1:
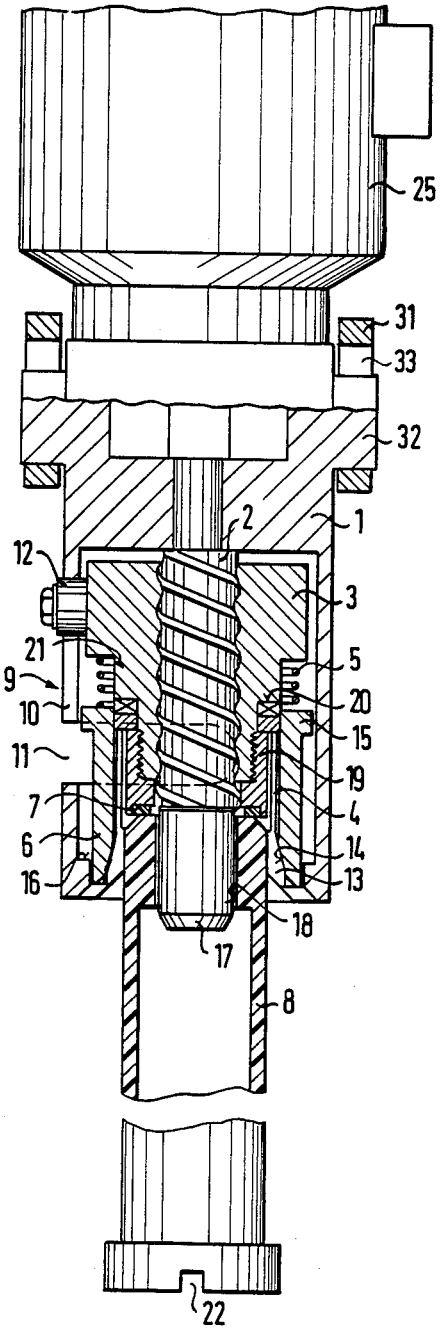
FIG. 1 is a view partially in side elevation and partially in vertical cross-section illustrating the preferred embodiment of the apparatus of the present invention in operative disposition gripping an empty roving bobbin in preparation for a donning operation.

Referring now to the accompanying drawings and initially to FIG. 1, the apparatus of the present invention includes a cylindrical housing 1 having an open lower end for receiving one longitudinal end of a roving bobbin 8, with a coarsely threaded spindle 2 rotatably mounted coaxially within the housing 1 and with an annular drive nut 3 threadedly supported on the spindle 2 within the housing 1. A gripping member 4 of an annular cage-like construction is supported annularly about the downwardly facing end of the drive nut 3 and a thrust ring 6 is supported within the housing 1 annularly about the gripping cage 4.

The housing 1 is formed with an L-shaped guide slot 9 having one vertical extent oriented substantially parallel to the axis of the housing and a horizontal extent 11 oriented substantially perpendicularly to the vertical extent 10. A guide roller 12 is mounted on the drive nut 3 to extend outwardly within the L-shaped guide slot 9.

The periphery of the drive nut 3 is of a step-like configuration with the lowermost end of the drive nut 3 being of a reduced diameter from which a shoulder surface 20 extends radially outwardly, with a cylindrical surface 21 extending axially from the shoulder 20. An annular bushing 19 is threadedly supported on the lowermost end of the drive nut 3 and the downward axial end face of the bushing 19 is fitted with a friction ring 7 formed of a material having a high coefficient of friction with respect to the bobbin 8. The gripping cage 4 includes a ring-like base mounted annularly about the bushing 19 in axial facing relation to the shoulder 20 of the drive nut 3, with a plurality of resilient spring-like gripping fingers 13 extending axially downwardly from the cage base annularly about the bushing 19. The thrust ring 6 is of an inner diameter corresponding to the outer diameter of the cylindrical surface 21 of the drive nut 3, the upper end of the thrust ring 6 being formed with a radially outwardly projecting shoulder 15 which axially faces a radially inwardly projecting shoulder 16 formed at the lower end of the housing 1. A helical coil-type spring 5 is disposed annularly about the cylindrical surface 21 of the drive nut 3 to extend axially between the drive nut 2 and the upper end of the thrust ring 6 to bias the drive nut 3 and thrust ring 6 away from one another into a normal relative axially spaced relationship. The downwardly projecting ends of the gripping fingers 13 are radially outwardly tapered, with the lower end of the thrust ring 6 being compatibly tapered outwardly at 14 to provide a cam surface.

The threaded spindle 2 is supported at its upper end by the housing 1 for selectively reversible rotational movement relative to the housing 1 in either opposite rotary direction, but is mounted against any axial movement with respect to the housing 1. A reversible electric motor 25 of a conventional construction is mounted on the upper end of the housing 1 in driving association with the spindle 2. The lowermost depending end of the threaded spindle 2 is provided with an unthreaded region 17 of a diameter that corresponds to an axial opening 18 formed at the upper end of the roving bobbin 8. The base of the bobbin 8 is formed with a drive recess 22 configured to receive a mated driving member 23 (FIG. 2) on the winding spindle 24 of a roving machine.

The overall apparatus of the present invention as described is suspended in depending fashion from a carriage 31 in a manner permitting limited movement of the apparatus axially toward and away from the bobbin 8. The housing 1 includes integral outwardly projecting flanges 32 which are received within oversized slots 33 in the carriage 31 by which a degree of axial movement of the present apparatus relative to the carriage 31 is permitted.

The operation of the present apparatus will thus be understood. In FIG. 1, the apparatus is depicted in gripping relationship with an empty bobbin 8 ready for donning onto a compatible spindle 24 (FIG. 2) of a conventional roving machine. As will be noted, the spindle 24 has been rotated to fully retract the drive nut 3 upwardly within the housing 1 with the guide roller 12 disposed at the upper end of the extent 10 of the L-shaped guide slot 9. Correspondingly, the gripping member 4 and the thrust ring 6 are also fully withdrawn within the housing 1, with the tapered cam surface 14 of the thrust ring 6 in engagement with the compatibly tapered surfaces of the gripping fingers 13 causing th fingers 13 to be moved radially inwardly to securely grip and retain the upper end of the bobbin 8 coaxially about the unthreaded portion 17 of the spindle 2.

Upon operation of the electric drive motor 25 in the appropriate rotary direction, the spindle 2 is caused to rotate and, in turn, actuates a positive downward movement of the drive nut 3 since the disposition of the guide roller 12 within the extent 10 of the L-shaped guide slot 9 prevents rotational movement of the drive nut 3 with the spindle 2. As will be understood, the bushing 19 and its friction ring 7 move downwardly integrally with the drive nut 3 and, simultaneously, the downward movement of the drive nut 3 produces corresponding downward movement of the gripping member 4, the coil spring 5 and the thrust ring 6, while retaining gripping engagment of the bobbin 8. Just prior to the completion of this downward motion of the drive nut 3 and related components, the shoulder 15 of the thrust ring 6 engages the shoulder 16 of the housing 1 to prevent any further downward movement of the thrust ring 6. Thereafter the coil spring 5 compresses to permit continuing downward movement of the drive nut 3 and the gripping cage 4. As the downward movement of the drive nut 3 is completed, the gripping member 4 moves axially downwardly with respect to the thrust ring 6 to disengage the gripping fingers 13 from the tapered cam surface 14 of the thrust ring 6, thereby releasing the roving bobbin 8, as depicted in FIG. 2.

Figure 2:
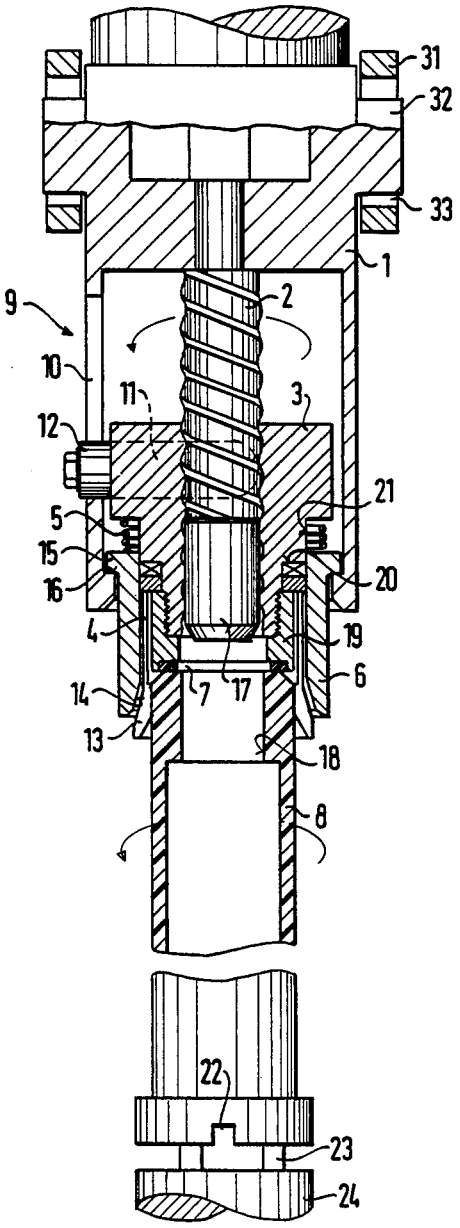
FIG. 2 is a view similar to FIG. 1 depicting the present apparatus during the donning operation.

At the completion of the downward motion of the drive nut 3, the base of the roving bobbin 8 rests on the drive member 23 of the winding spindle 24, normally with the bobbin drive recess 22 and the spindle drive member 24 out of mated engagement, as shown in FIG. 2, except in unusual circumstances when proper mated engagement occurs by chance coincidience. As the rotational movement of the threaded spindle 2 continues, the oversized slot 33 and the carriage 31 enable the entire apparatus to move axially as necessary until the guide roller 12 enters the horizontal extent 11 of the L-shaped guide slot 9, whereupon the drive nut 3 and related components rotate essentially unitarily with the spindle 2. As will be understood, the weight of the entire apparatus continues to be applied to the upper end of the roving bobbin 8, whereby the rotational movement of the drive nut 3 and its associated bushing 19 frictionally actuate corresponding rotational movement of the roving bobbin 8 until its drive recess 22 comes into proper mated engagement with the spindle drive member 23. Any continued rotation of the drive nut 3 and related components thereafter merely produces sliding movement of the bushing 19 and friction ring 7 with respect to the upper end of the bobbin 8 or the overall apparatus may move axially downwardly into resting engagement on the carriage 31.

In operation of the present apparatus for grasping and doffing a full roving bobbin, the apparatus while in its condition depicted in FIG. 2 is intially lowered over the upper end of a roving bobbin 8 to dispose the bobbin end within the gripping fingers 13 in end abutment with the friction ring 7 with the end opening 18 in the bobbin 8 coaxially aligned with the spindle 2. Upon reverse rotation of the threaded spindle 2, the drive nut 3 and associated components initially rotate with the spindle 2 while the guide roller 12 moves along the extent 11 of the L-shaped slot 9. Once the guide roller 12 reaches the juncture between the slot extents 10 and 11, further rotational movement of the drive nut 3 and associated components is prevented and such components begin to move upwardly along the spindle 2. Notably, at this point, the gripping fingers 13 are not as yet in gripping engagement with the roving bobbin 8. As such upward movement continues, the compression of the coil spring 5 is gradually released, whereby the thrust ring 6 does not move upwardly at the same rate as the gripping fingers 13 so that the tapered lower extent of the gripping fingers 13 gradually comes into engagement with the compatibly tapered cam surface 14 of the thrust ring 6 to force the gripping fingers 13 radially inwardly into gripping engagement with the upper end of the roving bobbin 8. As the upward movement of the drive nut 3 and the associated components continues, the gripped roving bobbin 8 is lifted upwardly and removed from its winding spindle 24.

As will thus be understood, the apparatus of the present invention uniquely provides for both rotational and longitudinal movement of the bobbin gripping components of the apparatus to insure efficient and reliable doffing and donning of roving bobbins on a textile roving machine while automatically providing for the establishment of positive driving connection between the mated drive components of the winding spindle and the roving bobbin. The provision of the helical coil spring 5 between the drive nut 3 and the thrust ring 6 assists in providing a flexible operation of the entire apparatus. Further, the formation of the spindle 2 with an unthreaded engagement end 17 for insertion within the axial end opening 18 of the roving bobbin 8 insures control of the proper desired upright orientation of the bobbin 8 and avoids possible tilting of the bobbin during the doffing and donning operation.

Figure 3:
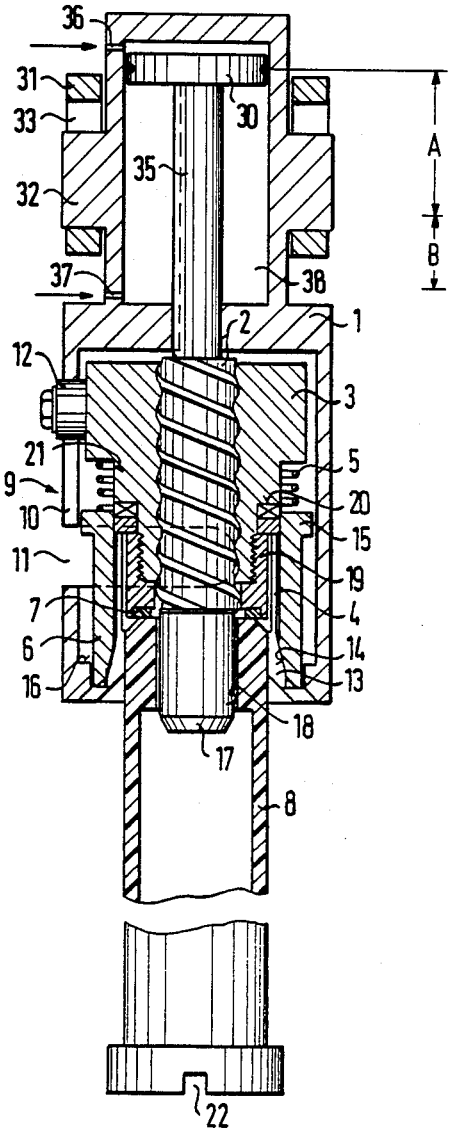
FIG. 3 is a similar view to FIG. 1 illustrating another embodiment of the apparatus of the present invention.

Referring now to FIG. 3, there is illustrated an alternative embodiment of the present apparatus wherein a pneumatically operated piston and cylinder unit is utilized as the means of driving the threaded spindle 2. In this embodiment, a piston 30 is reciprocably supported within a cylindrical chamber 38 for fluid-actuated reciprocal movement back and forth therein in a dual-acting manner by the introduction and exhaust of pressurized fluid at opposite sides of the piston 30 through inlet and outlet ports 36 and 38. The piston rod 35 is operatively connected coaxially with the threaded spindle 2 to actuate longitudinal reciprocation of the spindle 2. Thus, in contrast to the above-described embodiment of FIGS. 1 and 2, the spindle 2 in this embodiment is restrained against rotation relative to the housing 1 while being longitudinally reciprocable relative thereto. The construction and operation of the remaining components is otherwise substantially the same as in FIGS. 1 and 2.

In operation, the reciprocation of the piston 30 within the extent A of its longitudinal stroke will be understood to produce substantially unitary axial reciprocation of the threaded spindle 2 and the guide nut 3 and associated bobbin gripping components, inasmuch as the guide roller 12 remains within the vertical extent 10 of the L-shaped guide slot 9 throughout the extent A of the piston stroke. On the other hand, within the extent B of the piston stroke, the guide roller 12 is positioned to move within the horizontal extent 11 of the guide slot 9 whereby the drive nut 3 is prevented from axial movement with the spindle 2 and, accordingly, the axial spindle movement is converted into rotational movement of the drive nut 3 and its related gripping components, the gripping member 4, spring 5 and thrust ring 6.

It will therefore be readily understood by those persons skilled in the art that the present invention is susceptible of a broad utility and application. Many embodiments and adaptations of the present invention other than those herein, described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for selectively gripping and releasing a roving bobbin for use in doffing and donning a roving bobbin on a winding spindle of a roving machine wherein said bobbin and said winding spindle have mating drive components for establishing drive connection therebetween, said apparatus comprising gripping means arranged for movement into and out of gripping engagement with said bobbin and five means for selectively actuating said movements with said bobbin and drive means for selectively arranged for movement longitudinally with respect to said spindle and said drive means being further arranged for rotational movement with respect to the axis of said spindle for orienting said drive component of said bobbin relative to said mating drive component of said spindle for proper driving connection thereof.

2. Apparatus for selectively gripping and releasing a roving bobbin according to claim 1 and characterized further by a housing adapted for axially receiving one longitudinal end of said bobbin, said housing supporting said gripping means and said drive means for operation with respect to said one bobbin end and said housing defining a generally L-shaped guide slot having one extent oriented generally parallel to the axis of said bobbin and another extent oriented generally perpendicular to said one extent, said drive means having a guide component disposed for movement within said guide slot for guiding movement of said drive means.

3. Apparatus for selectively gripping and releasing a roving bobbin according to claim 2 and characterisized further in that said guide component comprises a guide roller.

4. Apparatus for selectively gripping and releasing a roving bobbin according to claim 2 and characterized further in that said drive means comprisea a threaded drive spindle mounted on said housing, and drive nut means threadedly supported on said drive spindle and having a axial drive surface for engagement with said one end of said bobbin.

5. Apparatus for selectively gripping and releasing a roving bobbin according to claim 4 and characterized further in that said guide component is mounted on said drive nut means for determining movement of said drive nut means unitarily with said drive spindle and rotationally thereabout.

6. Apparatus for selectively gripping and releasing a roving bobbin according to claim 4 and characterized further in that said drive spindle is mounted to said housing against axial movement relative thereto and for selective reversible rotation thereto in opposite rotary directions.

7. Apparatus for selectively gripping and releasing a roving bobbin according to claim 6 and characterized further in that said drive means comprises an electric motor for rotating said drive spindle.

8. Apparatus for selectively gripping and releasing a roving bobbin according to claim 4 and characterized further in that said drive spindle is mounted to said housing against rotation relative thereto and for selective axial reciprocation relative thereto.

9. Apparatus for selectively gripping and releasing a roving bobbin according to claim 8 and characterized further in that said drive means comprises a fluid operated piston-and cylinder unit for reciprocating said drive spindle.

10. Apparatus for selectively gripping and releasing a roving bobbin according to claim 4 and characteerized further in that said gripping means comprises a plurality of gripping fingers arranged annularly about said axial drive surface of said drive nut means and a thrust ring arranged within said housing annularly about said gripping fingers and in association with said drive nut means for movement by said drive nut means axially with respect to said housing for actuating movement of said gripping fingers into and out of gripping engagement with said bobbin.

11. Apparatus for selectively gripping anad releasing a roving bobbin according to claim 10 and characterized further in that said thrust ring includes a tapered cam surface for acting on said gripping fingers and a shoulder for retaining said thrust ring within said housing.

12. Apparatus for selectively gripping and releasing a roving bobbin according to claim 10 and characterized further by spring means arranged within said housing between said thrust ring and said drive nut means for biasing said thrust ring and drive nut means in axial relation to one another while permitting relative axial movement toward one another.

13. Apparatus for selectively gripping and releasing a roving bobbin according to claim 10 and characterized further in that said drive nut means includes a shoulder extending radially inwardly from an outer annular surface, said shoulder acting on one end of said gripping fingers and said thrust ring encircling said outer annular surface about said gripping fingers.

14. Apparatus for selectively gripping and releasing a roving bobbin according to claim 4 and characterized further in that said one longitudinal end of said bobbin has recess therein for receiving an end of said spindle adjacent said axial drive surface of said drive nut means.

15. Apparatus for selectively gripping and releasing a roving bobbin according to claim 4 and characterized further in that said drive nut means includes a bushing forming said axial drive surface of said drive nut means and a friction ring formed on said bushing for engagement with said one end of said bobbin.

* * * * *